United States Patent [19]

Cornelisse, Jr. et al.

[11] 4,305,162

[45] Dec. 15, 1981

[54] PASSIVE DOSING DISPENSER EMPLOYING CAPTIVE AIR BUBBLE TO PROVIDE PRODUCT ISOLATION

[75] Inventors: William Cornelisse, Jr., Fairfield; Robert H. Callicott, West Chester; Michael A. Brunsman, Cincinnati, all of Ohio

[73] Assignee: The Procter & Gamble Company, Cincinnati, Ohio

[21] Appl. No.: 205,112

[22] Filed: Nov. 10, 1980

[51] Int. Cl.[3] ..... E03D 9/02

[52] U.S. Cl. ..... 4/228; 4/227; 222/424.5

[58] Field of Search ..... 4/228, 227, 222; 222/424.5, 416, 204, 57, 54

[56] References Cited

U.S. PATENT DOCUMENTS

| | | | |
|---|---|---|---|
| 650,161 | 5/1900 | Williams et al. | 4/228 |
| 1,175,032 | 3/1916 | Williams | 4/228 |
| 3,121,236 | 2/1964 | Yadro et al. | 4/228 |
| 3,407,412 | 10/1968 | Spear | 4/228 |
| 3,423,182 | 1/1969 | Klasky | 4/228 X |
| 3,444,566 | 5/1969 | Spear | 4/228 X |
| 3,769,640 | 11/1973 | Castronovo | 4/228 |
| 3,772,715 | 11/1973 | Nigro | 4/228 X |
| 3,778,849 | 12/1973 | Foley | 4/228 X |
| 3,781,926 | 1/1974 | Lavey | 4/228 |
| 3,831,205 | 8/1974 | Foley | 4/228 |
| 3,934,279 | 1/1976 | Mallin | 4/228 |
| 3,943,582 | 3/1976 | Daeninckx et al. | 4/227 |
| 3,952,339 | 4/1976 | Baur et al. | 4/228 |
| 4,064,572 | 12/1977 | Wick et al. | 4/227 |
| 4,171,546 | 10/1979 | Dirksing | 4/227 X |
| 4,186,856 | 2/1980 | Dirksing | 222/424.5 |
| 4,208,747 | 6/1980 | Dirksing | 4/227 X |
| 4,216,027 | 8/1980 | Wages | 4/228 X |

*Primary Examiner*—Henry K. Artis

*Attorney, Agent, or Firm*—Richard C. Witte; Thomas H. O'Flaherty; John Gorman

[57] ABSTRACT

A passive dosing dispenser for issuing, for example, a volume of a toilet tank additive solution into a toilet tank as the water is draining therefrom while the toilet is flushing. A preferred dispenser comprises a product chamber for containing a quantity of a solid type product which can be dissolved in water to form a toilet tank additive product solution, a solution reservoir for containing a quantity of said solution in fluid communication with said product chamber, an inlet/discharge conduit having its lowermost end in fluid communication with said solution reservoir and its uppermost end in fluid communication with a syphon tube, a first air trap disposed adjacent said inlet/discharge conduit for trapping an air bubble that is used for isolating said product solution from the toilet tank water in the syphon tube during quiescent periods, a second air trap disposed adjacent the syphon tube for retaining the air bubble while the water is draining from the toilet tank during flushing, a discharge reservoir disposed at the outlet end of the syphon tube to retard the discharge of the toilet tank additive product solution so that the discharge requires a predetermined period of time, and an air vent in fluid communication with the solution reservoir and the product chamber.

17 Claims, 14 Drawing Figures

PASSIVE DOSING DISPENSER EMPLOYING CAPTIVE AIR BUBBLE TO PROVIDE PRODUCT ISOLATION

FIELD OF THE INVENTION

The present invention relates to a dosing type dispenser for use in dispensing such products as toilet tank additives: e.g., disinfectants, aerosolization retardants, and the like. In particular, the present invention comprises an entirely passive (no moving parts) dispenser in which a solid type product will gradually be dissolved to form a solution, and from which dispenser such solution can be incrementally issued. A predetermined quantity or dose-volume of solution is available for issuing each time the water in the toilet tank receeds from around the dispenser. The predetermined quantity or dose-volume of solution will issue so long as the toilet tank does not refill up to the inlet/discharge port of the syphon tube prior to the end of the period of time necessary for completely discharging the solution. If the toilet tank refills too quickly then the quantity of solution actually issued will be approximately equal in proportion to the proportion of the actual time elapsed to the period of time that is required for a complete discharge. Dispenser embodiments of the present invention also provide means for make-up water to enter the dispenser and provide for air-lock isolation of the product and product solution from surrounding toilet tank water during quiescent periods. In normal operation an air bubble is trapped in a first air lock while the make-up water is entering the dispenser. When the toilet is flushed, the air bubble is trapped in the second air trap as the solution is discharged. In the event the toilet tank refills before the period of time required for a complete discharge of the product solution, the dispenser can still provide air-lock isolation of the product and product solution from the surrounding toilet tank water since the second air trap has retained the air bubble that forms the air lock. Plural product dispenser embodiments are also provided which can, because each segment provides product and product solution isolation from the toilet tank water during quiescent periods, co-dispense solutions of two or more products which should not be mixed before their intended use.

BACKGROUND OF THE INVENTION

Passive dosing dispensers of various geometries are disclosed in prior art patents. For instance, U.S. Pat. No. 650,161 which issued to J. Williams et al. on May 22, 1900 and U.S. Pat. No. 1,175,032 which issued to E. R. Williams on Mar. 14, 1916 disclose passive dispensers which are alternately flooded and then syphoned to a predetermined level. Also, U.S. Pat. No. 3,772,715 which issued to L. V. Nigro on Nov. 20, 1973, and U.S. Pat. No. 3,781,926 which issued to J. Levey on Jan. 1, 1974, and U.S. Pat. No. 3,943,582 which issued to J. Daeninckx et al. on Mar. 16, 1976 disclose passive dispensers which are alternately flooded and then gravitationally drained. Moreover, U.S. Pat. No. 3,407,412 which issued to C. T. Spear on Oct. 29, 1968, and U.S. Pat. No. 3,444,566 which issued to C. T. Spear on May 20, 1969 disclose dispensers which, although they have no moving parts, must be connected to a pressurized water supply such as the trap refill tube in a toilet tank and in which the direction of flow alternates in labyrinth passages.

Passive dosing dispensers of the type disclosed in the commonly assigned U.S. Pat. No. 4,208,747 issued to Robert S. Dirksing on June 24, 1980 and entitled PASSIVE DOSING DISPENSER EMPLOYING TRAPPED AIR BUBBLE TO PROVIDE AIR-LOCK, which is hereby incorporated herein by reference, have solved many of the problems associated with the aforementioned prior art dispensers, most particularly the problem of providing solid product and liquid product solution isolation from surrounding toilet tank water during quiescent periods. Dispenser embodiments of the type generally disclosed in FIGS. 1 and 15–18 of the aforesaid U.S. Patent of Robert S. Dirksing, which function in a manner generally similar to the improved dispenser embodiments of the present invention, have been found particularly suitable for dispensing liquid solutions formed from solid products containing a surfactant. However, in some instances the product additive solution needs to be discharged at a relatively slow rate and it is conceivable that the toilet tank would refill with water prior to completion of the discharge operation. If the toilet tank refilled up to the inlet/discharge port of the syphon tube before the discharge operation was completed, then there would be no way to reform the air bubble and reform the air lock to provide for isolation of the product solution from the surrounding toilet tank water in a dispenser embodiment of the type disclosed in the aforesaid U.S. Patent of Robert S. Dirksing since the air bubble would have been discharged along with the product solution at the beginning of the discharge operation.

In addition, some compositions of the solid product used to form the product additive solution are somewhat slow to disperse in the toilet tank water. In such instances, it becomes preferable to provide a sufficient amount of time for the dispersion of the product solution into the toilet tank water to occur so that the additive product solution can function optimally. One method to accomplish this would be to provide a means for retarding the solution discharge, e.g., an enlarged discharge reservoir at the end of the syphon tube with an appropriately sized inlet/discharge port or ports, such that the bulk of the solution is discharged after the flush cycle is completed, i.e. when the toilet tank is refilling. This allows the solution to disperse into the toilet tank water during the quiescent periods between each flush. The dispensers of the aforesaid U.S. Patent of Robert S. Dirksing do not provide a means for such a delayed discharge.

SUMMARY OF THE INVENTION

In accordance with one aspect of the invention, a dispenser is provided which comprises an internal product chamber for containing a quantity of a solid product in fluid communication with a solution reservoir for containing a quantity of product solution, and means for causing a quantity of said solution to be conducted from said solution reservoir and issue from the dispenser in response to the level of a body of surrounding liquid being lowered from a first elevation to a second elevation. Such a dispenser can comprise a product chamber, a solution reservoir in fluid communication with said product chamber, an inlet/discharge conduit having a first air trap disposed adjacent thereto, said conduit having its lowermost end in fluid communication with said solution reservoir, a syphon tube extending downwardly from said solution reservoir having its uppermost end in fluid communication with the uppermost end of the inlet/discharge conduit, said syphon tube also having a second air trap disposed adjacent thereto and an enlarged discharge reservoir disposed at the discharge end thereof, said discharge reservoir having at least one inlet/discharge port, said dispenser also having an air vent in fluid communication with said solution reservoir and said product chamber.

The first air trap, disposed adjacent the inlet/discharge conduit, acts to retain an air bubble when water enters the solution reservoir via the syphon tube and the inlet/discharge conduit as the water level in the toilet tank returns to the FULL level. As long as water is flowing inwardly through the inlet/discharge conduit the air bubble is retained in the first air trap. However, when the air vent in fluid communication with the solution reservoir is blocked by the rising water level in the toilet tank and forms an air-lock between the solution within the solution reservoir and the toilet tank water or when the water level in the toilet tank ceases to rise and this occurs prior to blockage of the air vent, the inward flow of water through the syphon tube and the inlet/discharge conduit ceases, and, due to the geometry of the inlet/discharge conduit, the first air trap, and the connecting passageway joining the syphon tube and the inlet/discharge charge conduit, the trapped air bubble relocates itself into the headspace joining the upper reaches of the inlet/discharge conduit and the syphon tube. The air bubble then acts to isolate the toilet tank water in the syphon tube from the product solution contained in the solution reservoir and the inlet/discharge conduit until the next flush cycle. As a result the product and product solution are completely isolated from the surrounding toilet tank water during quiescent periods intermediate the flush cycles.

The second air trap, disposed adjacent the syphon tube, acts to retain the same air bubble that relocated into the headspace joining the upper reaches of the inlet/discharge conduit and the syphon tube when the water level in the toilet tank falls from the first elevation to a point just below the inlet/discharge port of the syphon tube. While the product solution is being drawn through the syphon tube and the discharge reservoir to be discharged into the toilet tank water and while the toilet tank water is still at a level below the inlet/discharge port of the syphon tube, the air bubble is retained in the second air trap. However, when the rising water level in the toilet tank reaches the inlet/discharge port of the syphon tube and the discharge reservoir and begins to enter the discharge reservoir prior to completion of the discharge operation, the air bubble is forced from the second air trap, pushed into the inlet/discharge conduit and is then trapped in the first air trap as described above. If the discharge of the product solution is completed before the rising water level reaches the inlet/discharge port of the syphon tube, then the entire syphon tube fills with air and when the toilet tank water level finally reaches the inlet/discharge port of the syphon tube, a portion of the air in the syphon tube is trapped in the first air trap as described above.

The discharge reservoir at the end of the syphon tube preferably acts in conjunction with the inlet/discharge port or ports in the syphon tube to delay the discharge of the product solution such that the bulk of the product solution is not discharged into the toilet tank water until after the flush cycle, i.e. from the point that the flapper valve opens until the flapper valve closes again, is completed and the toilet tank is refilling with water.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

DETAILED DESCRIPTION OF THE INVENTION

Figure 1:
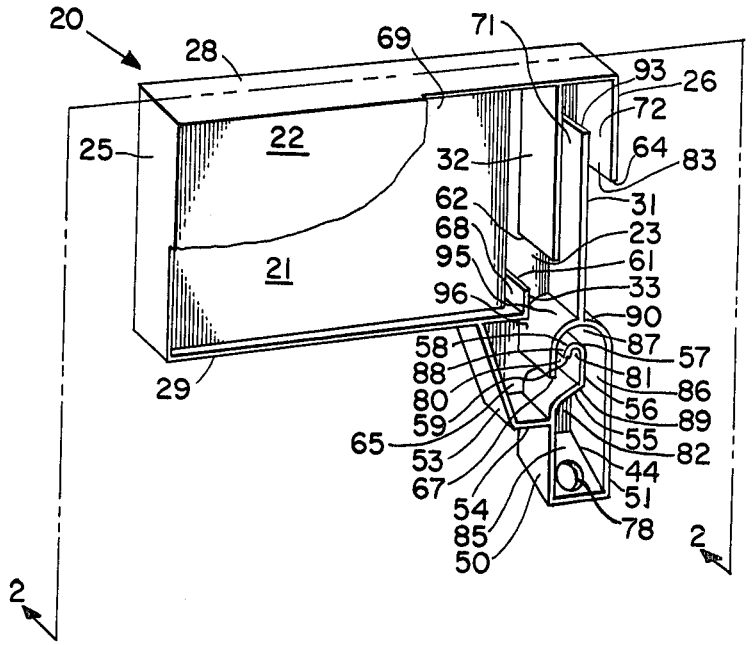
FIG. 1 is a partially torn away perspective view of a passive dosing dispenser which is an embodiment of the present invention.

Referring now to the figures in which identical features are identically designated, FIG. 1 shows a preferred dispenser 20 embodying the discharge means and the air bubble retention means of the present invention and containing a solid-state, water soluble product 21. Dispenser 20 comprises a front wall 22, a back wall 23, sidewall segments 25, 26, 31, 50, 51, and 90, a top wall 28, bottom wall segments 29, 53 and 54, and interior partitions 32, 33, 55, 56, 57, 58, 95 and 96. The walls and partitions are rigid and define solution reservoir 65 for the liquid solution, a solid product chamber 69, a syphon tube 44 having a discharge reservoir 85 and an air trap 82 disposed adjacent thereto, uppermost vertical passageway 86, a horizontal passageway 87, a vertical passageway 88 connecting with inlet/discharge conduit 80, said inlet/discharge conduit 80 having an air trap 81 disposed adjacent thereto, and vent means for the product chamber comprising passageways 71 and 72 and air vent 83. The lowermost edge of partition segment 58 is designated 59, the lowermost edge of partition segment 96 is designated 67, the lowermost edge of partition segment 56 is designated 89, the uppermost edge of partition segment 33 is designated 61, the lowermost edge of level control partition 32 is designated 62, the uppermost edge of sidewall segment 31 is designated 93, and the lowermost edge of sidewall segment 26, which in conjunction with front and back walls 22 and 23, respectively, and sidewall segment 31 define air vent 83, is designated 64. The discharge reservoir 85 for delaying the discharge of the liquid solution is located at the end of the syphon tube 44, and the inlet/discharge port of dispenser 20, located at the lowermost end of reservoir 85 and syphon tube 44, is designated 78.

Figure 2:
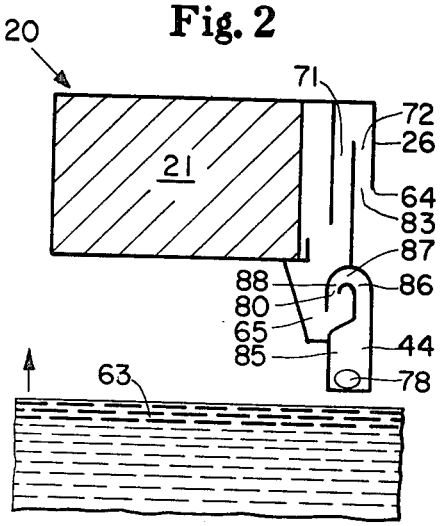
FIGS. 2, 3, 5, 7 and 9 are simplified, sequential, sectional views which show a portion of a cycle of the dispenser shown in FIG. 1 and which views are taken along section line 2—2 of FIG. 1.

Referring to FIG. 2, when a dispenser 20 containing solid product 21 is disposed, for instance, in a toilet tank (not shown) on a bracket or other mounting means (not shown) so that the FULL level of water 63 in the toilet tank is sufficiently high to at least reach edge 64 of sidewall segment 26, the dispenser will respond as shown in FIGS. 2–9 as the level of water drops from the FULL position in the toilet tank when the toilet is flushed and thereafter as the level of water in the toilet tank rises to the FULL position after completion of the flush cycle.

Figure 3:
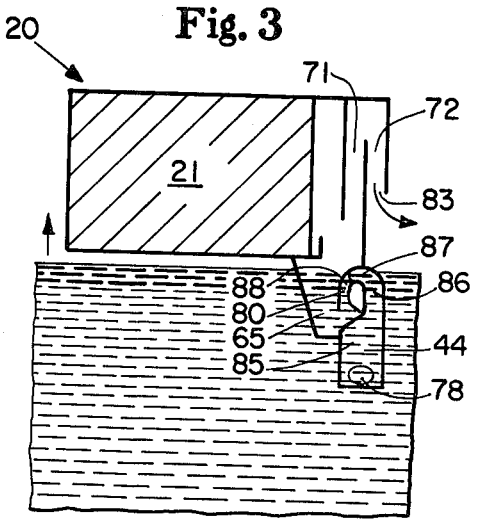

The dispenser 20, illustrated in FIG. 2, is shown prior to the charging operation, i.e. before it is immersed in the toilet tank water 63. As the toilet tank water 63 rises, as shown in FIG. 3, it enters syphon tube 44 and discharge reservoir 85 through inlet/discharge port 78. Air within the upper reaches of the syphon tube 44 is allowed to vent through discharge reservoir 85, vertical passageway 86, horizontal passageway 87, vertical passageway 88, inlet/discharge conduit 80, liquid solution reservoir 65, vent passageways 71 and 72 and air vent 83. As the level of the toilet tank water 63 continues to rise, it begins to enter horizontal passageway 87. Because the difference in elevation of the water in the toilet tank and the water within the syphon tube is relatively small prior to air vent 83 becoming blocked, the water head or water pressure available to force the water in syphon tube 44 around the loop through vertical passageway 88 and into inlet/discharge conduit 80 is likewise quite small. To minimize the required driving force to initiate water flow through the loop, the dispenser 20 preferably employs a series of passageways 86, 87 and 88, each of which is smaller in cross-section than any portion of the one immediately preceding it, thereby providing capillary suction in the direction of flow which tends to draw the water from the syphon tube 44 into the inlet/discharge conduit 80. This feature is more clearly illustrated in the enlarged fragmentary view of FIG. 4. It is of course recognized that a maximum degree of capillary suction may be provided by employing passageways 86, 87 and 88 which are tapered and exhibit a continual reduction in cross-section in the direction of liquid flow during the dispenser charging operation. If desired, the entire length of the syphon tube 44 above the discharge reservoir 85 may be convergent in the direction of water flow during the charging operation.

Figure 4:
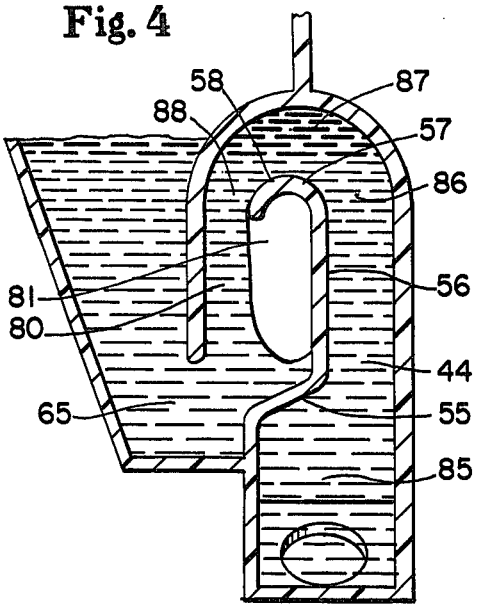
FIG. 4 is an enlarged fragmentary sectional view of the air trap portions of the dispenser of FIG. 1 in the condition illustrated in FIG. 3.

Once toilet tank water 63 enters inlet/discharge conduit 80 and begins to collect in the solution reservoir 65, the condition illustrated in FIG. 4 prevails in the air trap 81 disposed adjacent inlet/discharge conduit 80. Namely, an air bubble is retained within the confines of the air trap 81 defined by partition segments 55, 56, 57 and 58. The condition illustrated in FIG. 4 persists as long as toilet tank water 63 continues to enter the dispenser 20.

Figure 5:
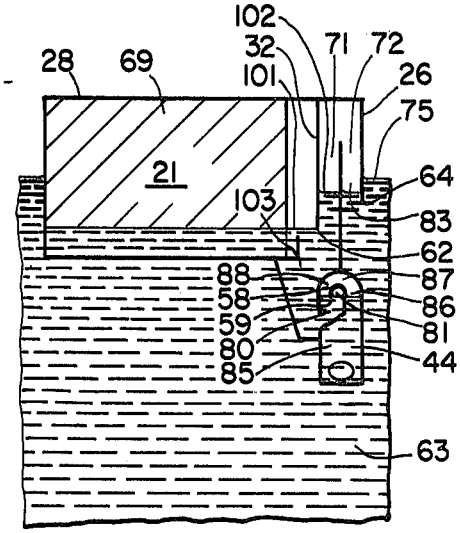
Figure 6:
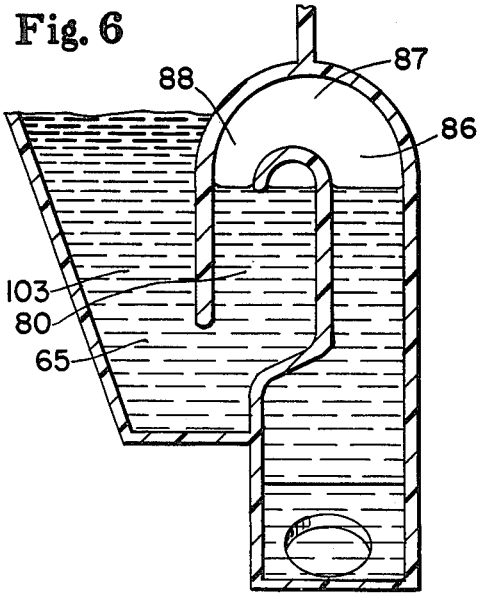
FIG. 6 is an enlarged fragmentary sectional view of the air trap portion of the dispenser of FIG. 1 in the condition illustrated in FIG. 5.

Referring now to FIG. 5, when the level 101 of incoming liquid within dispenser product chamber 69 reaches lowermost edge 62 of level control partition 32, an air-lock is formed in the uppermost reaches of the product chamber 69, thereby preventing the liquid level 101 from rising further within the product chamber 69. It should be noted, however, that the solution level 102 in passageway 71 continues to rise until such time as the toilet tank water 63 contacts lowermost edge 64 of sidewall segment 26 and blocks air vent 83, thus providing a secondary air-lock in the uppermost reaches of passageway 71 and passageway 72. This secondary air-lock isolates the liquid product solution 103, formed by dissolution of the solid product 21 in the toilet tank water introduced during the charging operation, and the toilet tank water blocking air vent 83. As is apparent from FIG. 5, the level 102 of liquid within dispenser passageway 71 is identical to the level of toilet tank water 63 in passageway 72. The level 102 of product solution 103 in passageway 71 is distinct from the level 101 of the product solution within the product chamber 69 due to the presence of level control partition 32 in the illustrated embodiment. Should level control partition 32 be eliminated, the dispenser 20 would still function. However, the level of product solution within the product chamber 69 would be controlled exclusively by the vertical location of air vent 83, assuming the FULL level of the toilet tank is above the air vent 83.

In the event the FULL level of the toilet tank is below the air vent 83, the level 102 of product solution 103 in passageway 71 will be identical to the level 75 of the toilet tank water 63 surrounding the dispenser, while the level 101 of product solution 103 within product chamber 69 will be controlled by lowermost edge 62 of level control partition 32.

In the event level control partition 32 is eliminated and the FULL level of the toilet tank is below the air vent 83, the level of product solution 103 within the dispenser 20 will be identical to the level 75 of toilet tank water 63 surrounding the dispenser 20. In all cases, dispenser 20 will function to isolate the resultant product solution 103 contained in the upper reaches of product chamber 69 from the surrounding toilet tank water 63, whether or not air vent 83 is blocked by toilet tank water. In the event air vent 83 is blocked by toilet tank water, isolation is provided by means of an air-lock created in the upper reaches of passageway 72 in conjunction with the air lock created in horizontal passageway 87. In the event air vent 83 is not blocked by toilet tank water, the vent to atmosphere provides the desired location from the toilet tank water 63.

Figure 13:
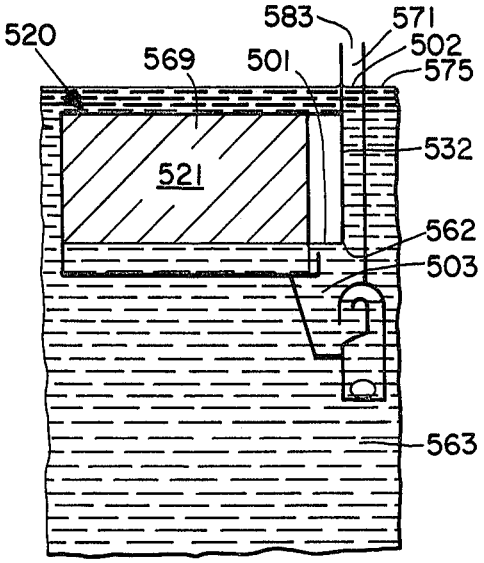
FIG. 13 is a simplified schematic of still another embodiment of the present invention shown after the water has reached its FULL level in the toilet tank.

By way of contrast, dispenser embodiment 520 of the present invention, illustrated in FIG. 13, discloses an alternative air vent structure to air vent 83, FIG. 5. The dispenser 520 must be so positioned in the toilet tank that the air vent 583 remains vented to atmosphere at all times, i.e., the air vent must be maintained above the FULL level of the toilet tank to ensure isolation of the product solution contained within the dispenser from the surrounding toilet tank water.

The dispenser embodiment 520 is, with the exception of reconstruction and relocation of air vent 583, similar to dispenser embodiment 20. However, passageway 72 has been eliminated from dispenser 20 and passageway 71 has been vertically extended beyond top wall 28 of dispenser 20 to form a single vertical passageway 571 in dispenser embodiment 520. Lowermost edge 562 of level control partition 532, which corresponds to lowermost edge 62 of level control partition 32 in dispenser 20, fixes the level 501 of product solution 503 formed by dissolution of solid product 521 within product chamber 569, while the level 502 of product solution 503 in passageway 571 is identical to the level 575 of the surrounding toilet tank water 563. As will be apparent from an inspection of FIG. 13, air vent 583 must at all times be maintained above the FULL level 575 of the toilet tank water 563 to ensure isolation of the product solution 503 from the toilet tank water. This is so because, unlike dispenser embodiment 20, vertical passageway 571 has no provision for forming an air-lock if the dispenser air vent 583 is immersed.

Referring again to FIG. 5, which represents the condition of the dispenser 20 when the toilet tank water level 75 has reached its FULL position, the bulk of the air bubble retained within air trap 81 during the charging operation has rotated about edge 59 of partition segment 58 so as to substantially fill horizontal passageway 87 as well as the uppermost portions of vertical passageways 86 and 88, there by isolating the resultant liquid product solution 103 contained within the inlet/-discharge conduit 80 from the toilet tank water 63 contained within passageway 86 of syphon tube 44. This feature is more clearly illustrated in FIG. 6, which is an enlarged fragmentary view of the air trap portions of the dispenser 20 illustrated in FIG. 5. It is thus clear that the resultant product solution 103 contained within passageway 71, product chamber 69, solution reservoir 65 and inlet/discharge conduit 80 is completely isolated from toilet tank water 63 by means of the air-lock provided in the uppermost sections of passageways 71 and 72 and the air-lock provided in the uppermost sections of vertical passageways 86 and 88 and horizontal passageway 87.

As will be appreciated by those skilled in the art, the toilet tank water 63 brought into contact with solid product 21 during the charging operation will continue to dissolve the solid product 21 at least until such time as the product solution 103 becomes saturated or until such time as the toilet is flushed and a predetermined quantity or dose-volume of the liquid product solution 103 is available for dispensing and is either completely or partially discharged. As will also be appreciated by those skilled in the art, the exterior surfaces of solid product 21 are preferably so configured as to permit a uniform degree of surface exposure to the solution 103 along the entire length and width of the solid product 21. To this end, the exterior surfaces of the solid product 21 may be longitudinally grooved, etc.

Figure 7:
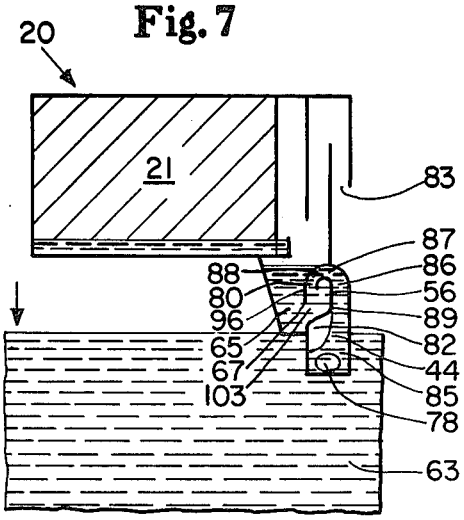
Figure 8:
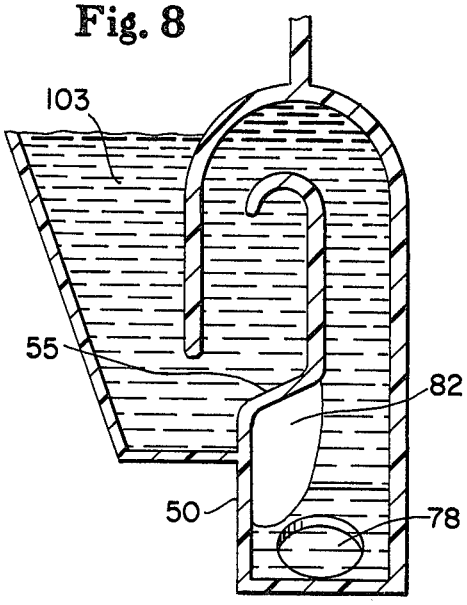
FIG. 8 is an enlarged fragmentary sectional view of the air trap portion of the dispenser of FIG. 1 in the condition illustrated in FIG. 7.

FIG. 7, represents the condition of the dispenser 20 when the toilet is flushed and the toilet tank water level drops, thereby exposing air vent 83 and forming a partial vacuum in the syphon tube 44. Product solution 103 is drawn from the solution reservoir 65 and inlet/discharge conduit 80 into the horizontal passageway 87 by way of vertical passageway 88 and then, along with the air bubble, it is drawn into the discharge reservoir 85 of syphon tube 44 by way of vertical passageway 86. As the air bubble passes the lowermost edge 89 of interior partition 56 it will move into the second air trap 82 allowing the product solution 103 to enter the discharge reservoir 85. This feature is more clearly illustrated in FIG. 8, which is an enlarged fragmentary view of the air trap portions of the dispenser 20 with the air bubble trapped in the second air trap 82 defined by partition segment 55, exterior wall segment 50, and back wall 23 as illustrated in FIG. 7. The condition illustrated in FIG. 8 persists as long as the solution 103 is discharging through inlet/discharge port 78.

Figure 9:
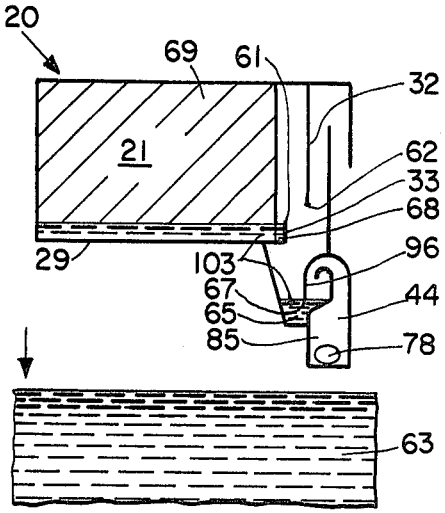

Transfer of product solution 103 from the solution reservoir 65 into the discharge reservoir 85 to be discharged through the inlet/discharge port 78 continues until such time as the solution level in solution reservoir 65 reaches edge 67 of partition segment 96, as shown in FIG. 9, thereby venting syphon tube 44 and allowing the product solution 103 contained therein to be released into the toilet tank water 63.

The discharge reservoir 85 preferably comprises an enlarged end of the syphon tube 44. The discharge reservoir 85 and its associated inlet/discharge port or ports 78 can be sized to provide for discharging of the product solution 103 of almost any composition, at almost any point in the flush cycle and at almost any rate of discharge. The specific composition of the product solution and the particular requirements for its intended use will obviously dictate the final design of the discharge reservoir 85 and even whether a discharge reservoir 85 is desired to delay the discharge.

By way of example, solid product compositions for use in automatic toilet tank dispensers may be specifically formulated to provide cleansing, disinfecting, deodorizing and/or other desired results. One such result found particularly useful is the treatment of the flush water of toilets in order to reduce the tendency of such flush water to produce aerosolization during the flushing of the toilet. Decreased aerosolization reduces the possibility of airborne transmission of disease causing organisms from the toilet wastewater. Solid product compositions capable of decreasing aerosolization of the flush water typically comprise a poly(ethylene oxide) resin, a surfactant and a water-soluble salt. It has been found that the presence of from 1 to 30 parts per million of a high molecular weight (i.e. molecular weights of from about 500,000 to 1,000,000) poly(ethylene oxide) resin in the toilet water will significantly reduce aerosolization.

However solid product compositions comprising a high molecular weight poly (ethylene oxide) resin tend to form a thick gel when exposed to the limited volume of water in automatic dispensers and are therefore somewhat slow to disperse throughout the toilet tank water. To ensure that the product solution additive formed from the dissolved solid product having the high molecular weight poly (ethylene oxide) resin and the toilet tank water is effectively dispersed throughout the toilet tank water, at least a portion of the product solution is preferably discharged after the toilet tank flush cycle has been completed and the toilet tank is refilling with water. By discharging at least a portion of the product solution at that point that portion of the product solution will have the quiescent period between flushes within which to disperse into the toilet tank water. As a result, the water to be used on the subsequent flush will be more effectively treated. To maximize the concentration of solution in the toilet tank it is, of course, preferrable to discharge substantially all of the product solution after completion of the flush cycle—the flush cycle being defined as the period beginning with the opening of the flapper valve and ending when the flapper valve closes—into the water that is being used to refill the toilet tank. However, if it is desired to provide a visual indication that the dispenser is working on each flush, it may be preferred to discharge a small amount of product solution into the water in the toilet tank late in the flush cycle i.e. into that portion of the toilet tank water which will be used to refill the toilet bowl on that particular flush cycle. The small amount of product additive discharged at that point will then disperse through the toilet bowl water and can be designed to provide some indication of its presence (e.g. color, perfume etc.)

A cake of solid composition, designed to reduce aerosolization and having as part of its composition a high molecular weight poly(ethylene oxide) resin, a surfactant, a perfume and a dye to provide a visual indication that the dispenser is working and that exhibits a gel forming tendency, was placed in an exemplary embodiment of the dispenser 20, employing air traps 81 and 82 and a discharge reservoir 85 of the present invention located at the discharge end of the syphon tube 44. The discharge reservoir 85 had an overall volume of about 3.0 ml with approximately 0.7 ml of the aforementioned volume adapted to function as the second air trap 82 for retention of the air-lock bubble. Because it has been found that multiple inlet/discharge ports further facilitate the dispersion of the product additive in the toilet tank, a pair of circular inlet/discharge ports about 0.075 inch in diameter were utilized to discharge the product solution. The exemplary dispenser had available a dose-volume of product solution 103 of 25 ml. The exemplary dispenser worked satisfactorily and the discharge operation, under normal concentration conditions, i.e. approximately 4 hours between flushes, completely discharged the solution in about 35 seconds. The discharge operation took the longest period of time, 130 seconds, at the first flush of the day or when the concentration level was much higher than normal.

The preferred dispenser for the solid product composition described above is shown in FIG. 14. The embodiment of the present invention illustrated in FIG. 14 functions in a manner generally similar to dispenser embodiments of the type generally disclosed in the commonly assigned Patent Application of Clement K. Choy, Ser. No. 153,997 filed May 28, 1980, and hereby incorporated herein by reference.

Figure 14:
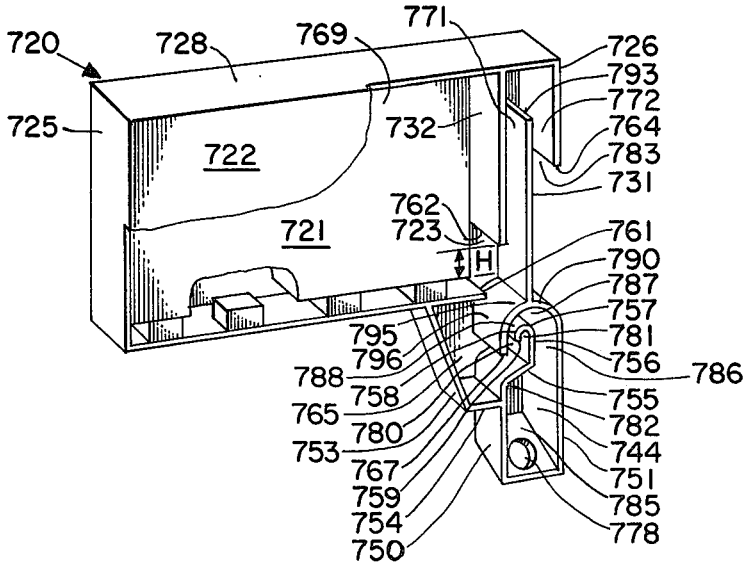
FIG. 14 is a partially torn-away perspective view of still another embodiment of a passive dosing dispenser of the present invention.

The dispenser embodiment 720 disclosed in FIG. 14 is, with the exception of solid product support members 733, similar to dispenser embodiment 20 shown in FIG. 1. To accommodate solid type products which have a substantial tendency to form a gel while dissolving or which are gooey or highly viscous, novel anti-clogging means are preferably provided within the product chamber to limit the amount of non-gelled solid product exposed to liquid and to maximize the area of contact between the liquid contained within the dispenser and the product. As will be apparent to those skilled in the art, where the solid product does not form a gel or other highly viscous solution the anti-clogging means are not necessary and the dispenser embodiment 20 in FIG. 1 is preferred.

The anti-clogging means comprise the support members 733 positioned in the lowermost portion of the product chamber 769 for the solid product 721 and level control means to control the liquid level within the product chamber. Because the aforementioned solid product support means 733 and level control means minimize the area of interface between the non-gelled solid product 721 and the liquid contained within the dispenser during quiescent periods, they minimize the quantity of gel formed within the dispenser when long periods of time elapse between flush cycles of the toilet. Furthermore, said support means help prevent the gelled portion of said solid product from obstructing the flow of liquid into and out of the product chamber. Thus, the support means also serve to maximize the area of contact between the liquid contained within the dispenser and the gelled product.

So long as liquid can enter and exit the product chamber during each flush cycle of the toilet, the gel will continue to dissolve or disperse into liquid solution which ultimately settles into the solution reservoir 765 located generally beneath the product chamber 769. Accordingly, the tendency of the incompletely dissolved gel to clog the present dispenser is minimized and that the novel anti-clogging means help ensure that dispensing of a quantity of liquid solution 703 will occur with each flush cycle of the toilet.

Referring now to FIG. 14, a preferred dispenser 720 embodying anti-clogging means and containing a solid-state, water soluble product 721 comprises a front wall 722, a back wall 723, sidewall segments 725, 726, 731, 750, 751, and 790, a top wall 728, bottom wall segments 729, 753 and 754, interior partitions 732, 755, 756, 757, 758, 795 and 796, and solid product support members 733. The solid product support members 733 are of lesser thickness than the width of the dispenser wall segments to ensure that liquid can wash across the lowermost surface of solid product 721 along its entire length. The walls and partitions are rigid and define a liquid solution reservoir 765 for a liquid solution, a solid product chamber 769, a syphon tube 744 having a second air trap 782 disposed adjacent thereof and having discharge reservoir 785, uppermost vertical passageway 786, a horizontal passageway 787, a vertical passageway 788 connecting with inlet/discharge conduit 780, said inlet/discharge conduit having a first air trap 781 disposed adjacent thereto, and vent means for the product chamber comprising passageways 771 and 772 and air vent 783. The lowermost edge of partition segment 758 is designated 759, the lowermost edge of partition segment 796 is designated 767, the exposed edge of bottom wall segment 729 is designated 761, the lowermost edge of level control partition 732 is designated 762, the uppermost edge of sidewall segment 731 is designated 793, and the lowermost edge of sidewall segment 726, which in conjunction with front and back walls 722 and 723, respectively, and sidewall segment 731 define air vent 783, is designated 764. The inlet/discharge port of dispenser 720 located at the lowermost end of syphon tube 744 is designated 778.

The depth of immersion of solid product 721 is controlled by the vertical distance "H" between the uppermost surface of product support members 733 and lowermost edge 762 of level control partition 732. Where the solid product 721 has a significant tendency to gel, it is preferred to minimize the amount of interface between the solid product and the liquid contained within the dispenser 720. This factor is particularly important in dispenser embodiments employing product chambers which have a relatively small or restricted area of fluid communication with the liquid solution reservoir in the dispenser. With dispenser embodiments of the type generally shown in FIG. 14 it has generally been found that the vertical distance "H" should be less than about $\frac{3}{8}$ inch, and most preferably less than about $\frac{1}{8}$ inch. In general, the greater the gelling tendency of solid product 721 and the smaller the area of fluid communication between the product chamber and the liquid solution reservoir, the smaller should be the depth of immersion "H".

The style and quantity of product support members employed in the practice of the present invention may take many different forms, such as dowels, planar shelves, or other protuberances secured to the front and/or back walls or extending from bottom wall segment 729 of dispenser 720. It has in general been found that for solid products exhibiting a strong gel forming tendency a greater support area is preferred, since this tends to slow the rate at which solid product 721 settles.

An exemplary dispenser embodiment of the present invention employing two shelf-like support members secured to and projecting from back wall 723, each of said support members having an overall height of about 0.7 inches, as measured from bottom wall segment 729, and an uppermost surface area of approximately 0.35 square inches each, has been found to function without clogging when allowed to stand in 75° F. water for periods of up to about four days with a surfactant-containing solid product. A vertical distance "H" of about 0.3 inches between the uppermost surface of the support members and the lowermost edge of the level control partition was employed. The solid product in question initially weighed about 60 grams and had a lowermost surface measuring 2.0" in length by about 0.5" in width.

Referring again to FIG. 9 it is apparent that uppermost edge 61 of partition segment 33 retains a portion of the concentrated product solution 103 within a secondary solution reservoir 68 after the dispensing operation has been completed. The solution 103 thus retained will be available to cover rapid multiple flushes of the toilet. For solid products which do not have an extreme gel forming tendency, the secondary solution reservoir 68 serves to prevent the collection of a thick concentrate of solution 103 in the lowermost portions of primary solution reservoir 65. However, as has been pointed out earlier herein, where solid products having an extreme gel forming tendency are employed, the secondary solution reservoir 68 is generally not utilized. The secondary solution reservoir 68, where utilized, the product chamber 69 and the solution reservoir 65 together comprise what is collectively referred to as an internal reservoir.

When the level 75 of the toilet tank water 63 returns to the FULL position, illustrated in FIG. 5, the dispenser 20 will likewise be restored to the condition illustrated in FIG. 5 and will remain in that condition during the ensuing quiescent period awaiting the next flush cycle of the toilet.

The dispenser embodiment 20 illustrated in FIGS. 1-9 can discharge a predetermined quantity or dose-volume of product solution 103 from the dispenser each time the toilet is flushed. The dose-volume of solution is substantially equal to the quantity of solution contained within dispenser 20 between lowermost edge 62 of level control partition 32 and lowermost edge 67 of partition segment 96 in addition to the column of product solution contained within passageway 71, but exclusive of the quantity of solution retained within secondary solution reservoir 68. The minimum quantity of product solution 103 retained in secondary reservoir 68 is in turn determined by the vertical location of edge 61 of partition segment 33. The amount of product solution 103 that can be dispensed during each flush cycle is more easily understood by comparing FIG. 5, which illustrates the condition of the dispenser 20 when the toilet tank water level 75 is FULL and air vent 83 has been blocked by the water, with FIG. 9, which illustrates the condition of the dispenser when the solution level within solution reservoir 65 has reached lowermost edge 67 of partition segment 96 and the dose-volume of solution has been released through inlet/outlet port 78.

As has been pointed out earlier herein, the solid, water soluble product 21 contained in product chamber 69 will dissolve in the water introduced during each flush cycle to form product solution 103 until such time as the solution becomes saturated or the toilet is again flushed. As the lower portions of the solid product 21 are consumed by exposure to the liquid, the solid product will settle due to gravity into the secondary reservoir 68 contained within product chamber 69. Because the volume and exposed surface area of solid product 21 below edge 62 of level control paritition 32 remain essentially constant throughout the life of the solid product, the strength or concentration of the solution 103 remains essentially constant throughout the life of the dispenser 20, assuming an adequately long quiescent period for the solution to reach a normal concentration level is provided intermediate the flush cycles, i.e. about 4 hours between flushes. It should be obvious that a shorter quiescent period will result in a solution 103 that will be less concentrated with dissolved solid product 21. However, in some instances this reduced concentration also means a less viscous solution 103 and as a result the discharging through inlet/outlet port 78 will be shortened as well.

While the dispenser embodiment illustrated in FIG. 1 incorporates preferred air traps 81 and 82 disposed adjacent the inlet/discharge conduit 80 and the syphon tube 44, respectively, the air traps utilized to retain an air bubble during both the water charging operation and the solution discharging operations may take many different forms. For example, a sudden expansion in cross-sectional flow area could be provided in vertical inlet passageway 88 followed immediately by a sudden contraction in flow area such that the fluid entering the primary reservoir 65 through the inlet/discharge conduit 80 is unable to exert sufficient force on the air bubble trapped within the expanded flow area to expel it through the primary reservoir 65 and out the air vent 83. Likewise, a sudden expansion in cross-sectional area could be provided adjacent the vertical passageway 86 followed immediately by a sudden contraction in flow area such that the solution 103 entering the syphon tube 44 is unable to exert sufficient force on the air bubble trapped within the expanded area to expel it through inlet/discharge port 78. Alternatively, the air traps could take the form of a partial obstruction in inlet/discharge conduit 80 and in syphon tube 44, which partial obstructions prevent fluid passing through the conduit 80 and the syphon tube 44 from exerting sufficient force on the air bubble retained within the traps from being expelled through either the solution reservoir 65 and out the air vent 83 or through inlet/discharge port 78, respectively. It is necessary only that the air traps be of sufficient volume and so located that upon cessation of the flow of water past the air traps the air bubble contained therein will then rise into the uppermost reaches of the chamber connecting the syphon tube 44 and the inlet/discharge conduit 80 so as to completely isolate the toilet tank water 63 in the syphon tube from the product solution 103 contained in the inlet/discharge conduit 80.

In addition, while the dispenser embodiment illustrated in FIG. 1 incorporates a preferred discharge reservoir 85 located at the discharge end of syphon tube 44, dispensers of the present invention do not necessarily need to employ a discharge reservoir. Without a discharge reservoir the discharging operation can be completed fairly quickly as with dispensers of the type disclosed in the commonly assigned U.S. Pat. No. 4,208,747 issued to R. S. Dirksing on June 24, 1980 and entitled PASSIVE DOSING DISPENSER EMPLOYING TRAPPED AIR BUBBLE TO PROVIDE AIR-LOCK, which is hereby incorporated herein by reference. However, dispensers disclosed in the aforesaid U.S. Patent of R. S. Dirksing are position sensitve in that the air-lock isolation of the product solution from the surrounding toilet tank water would be unavailable should the toilet tank refill prior to a complete discharge of the product solution. A dispenser 20 of the present invention having the air bubble retention means, e.g. second air trap 82, could be positioned at almost any point within a surrounding body of liquid and will continue to provide air lock isolation regardless of whether the discharging operation can be completed prior to a refilling of the toilet tank water up to the inlet/discharge port 78 of the dispenser 20.

Figure 10:
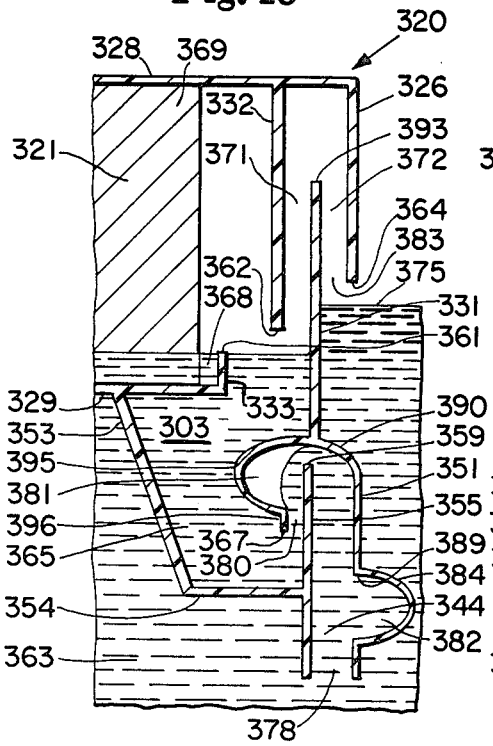
FIG. 10 is a fragmentary sectional view of another embodiment of a passive dosing dispenser of the present invention shown as the water level is rising in the toilet tank.

FIG. 10 is a fragmentary sectional view of an alternative embodiment of a dispenser 320 of the present invention shown during the water charging operation as the level 375 of water 363 in the toilet tank is rising. The dispenser 320 is basically similar to the dispenser 20 illustrated in FIG. 1 with the exception that there is no enlarged discharge reservoir 85 at the end of the syphon tube 44 and in that the air traps are of a different design. The illustrated portions of dispenser 320 comprise top wall 328, bottom wall segments 329, 353 and 354, sidewall segments 326, 331, 350 351, and 390, sidewall segment 384 forming air trap 382, interior level control partition 332, interior partitions 355 and interior partition 395 forming air trap 381 and interior partition segment 396 which in conjunction with the uppermost portion of wall segment 350 forms inlet/discharge conduit 380. As with the embodiment of FIG. 1, a solid, water soluble product 321 is disposed within product chamber 369 such that its lowermost surface rests within secondary solution reservoir 368 defined by interior partition segment 333 having uppermost edge 361. The lowermost edge of level control partition 332 is designated 362, the uppermost edge of wall segment 331 is designated 393, the lowermost edge of sidewall segment 326 is designated 364, the lowermost edge of sidewall segment 351 is designated 389, the uppermost edge of sidewall segment 355 is designated 359 and the lowermost edge of partition segment 396 is designated 367. Product chamber 369 and solution reservoir 365 are initially vented by means of passageways 371 and 372 and air vent 383 defined by edge 364 of sidewall segment 326, the front and back wall portions (not shown) of dispenser 320 and sidewall segment 331. In the case of dispenser 320, solution reservoir 365 and product chamber 369 including secondary solution reservoir 368, where utilized, together comprise what is collectively referred to as an internal reservoir. Syphon tube 344 is defined by sidewall segments 350, 351, 355, 384, 390 and which forms air trap 382, as well as the corresponding front and back wall portions (not shown) of dispenser 320. The inlet/discharge port located at the lowermost end of syphon tube 344 is designated 378. As with the embodiment illustrated in FIG. 1, the uppermost portions of the syphon tube 344 are preferably convergent, i.e., the radial distance from uppermost edge 359 of sidewall segment 355 to sidewall segment 390 and to interior partition 395 continually decreases in the direction of liquid flow. The air trap 381 formed by interior partition 395 is located adjacent the entrance to inlet/discharge conduit 380 and the air trap 382, formed by sidewall segment 384, is located adjacent the entrance to syphon tube 344.

Figure 11:
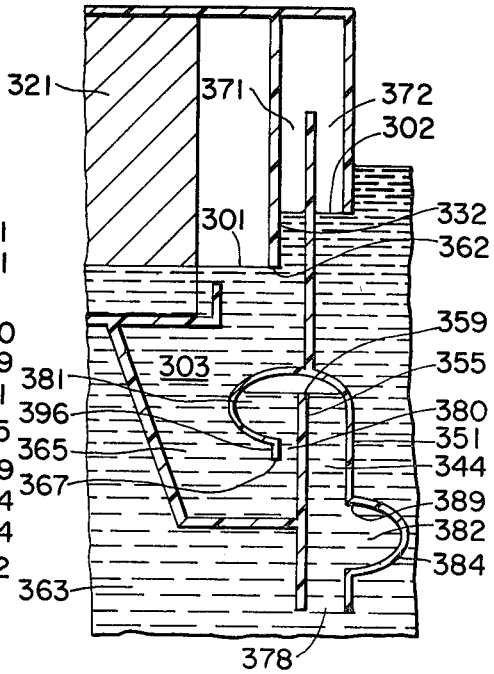
FIG. 11 is a fragmentary sectional view of the dispenser of FIG. 10 shown after the water has reached its FULL level in the toilet tank.
Figure 12:
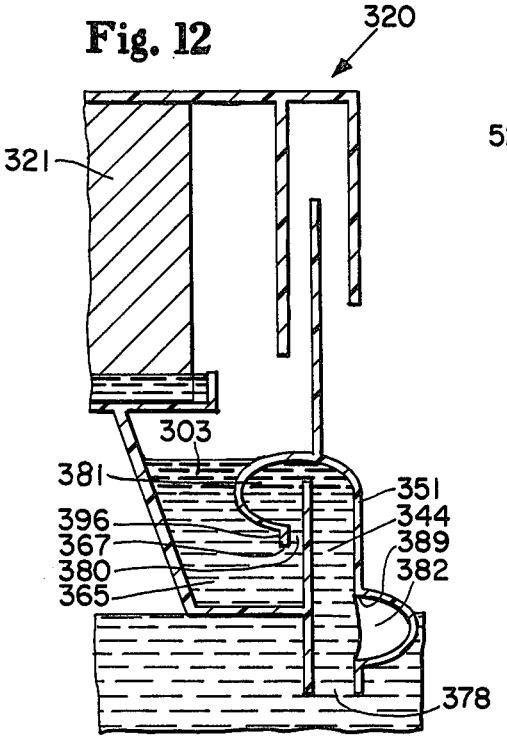
FIG. 12 is a fragmentary sectional view of the dispenser of FIG. 10 shown as the water level is dropping in the toilet tank.

In the condition illustrated in FIG. 10, the toilet tank water 363 has risen sufficiently in syphon tube 344 to trap an air bubble within air trap 381 as it proceeds to fill solution reservoir 365 and the lowermost portions of product chamber 369. As long as the water continues to flow into the syphon tube 344 and inlet/discharge conduit 380, the trapped air bubble will remain within the confines of the air trap 381. When, however, air vent 383 is blocked by the rising toilet tank water 363, as shown in FIG. 11, fluid flow in the inlet/discharge conduit 380 ceases, and the trapped air bubble rises, thereby providing air-lock isolation of the product solution 303 from the toilet tank water 363 on opposite sides of edge 359 of sidewall segment 355. The product solution 303 at level 302 within passageway 371 is likewise isolated from the toilet tank water by means of the air-lock contained in the uppermost reaches of passageways 371 and 372. The level 301 of product solution 303 within dispenser 320 is defined by lowermost edge 362 of level control partition 332 in a manner similar to that described in connection with embodiment 20 of FIG. 9. When the toilet is flushed, dispenser embodiment 320 reacts, as illustrated in FIG. 12, in a manner similar to embodiment 20 described in connection with FIG. 9. Product solution 303 is drawn from the solution reservoir 365 through the inlet/outlet conduit 380 and the air trap 381 forcing the air bubble into syphon tube 344 along with solution 303. As the air bubble passes lowermost edge 389 of sidewall segment 351 it will move into the second air trap 382. When the level of solution in primary reservoir 365 reaches lowermost edge 367 of partition segment 396, the column of liquid retained within syphon tube 344 is vented, thereby dispensing up to a predetermined quantity or dose-volume of product solution 303 into the toilet tank through inlet/discharge port 378.

As will be apparent to those skilled in the art, the dispenser 20 of FIG. 1, dispenser 520 of FIG. 13 and dispenser 720 of FIG. 14 can be equipped with alternative designs for trapping and retaining an air bubble during the water charging and solution discharging operations.

While the exemplary embodiments of dispensers 20, 320, 520 and 720 may be constructed by adhesively securing sections of relatively rigid Plexiglas (Registered Trademark of Rohm & Haas Company) to one another, other relatively rigid materials which are substantially inert with respect to the intended product and aqueous solutions thereof can be used to construct the dispensers. Furthermore, the dispensers may be constructed or formed at high speed and relatively low cost utilizing various manufacturing techniques well known in the art. For example, the dispensers could be vacuum thermoformed in two sections of a material such as polyvinyl chloride having an initial thickness of about 0.02 inches, the solid, water-soluble product inserted therebetween and the two sections thereafter secured to one another as by heat sealing, adhesives, etc. along a line of contact substantially coinciding with the location of section line 2—2 of FIG. 1. Alternatively, the full thickness dispenser configuration may be formed in one segment, the water soluble product inserted therein and the land areas of the full thickness segment subsequently secured to a planar segment to form the desired dispenser assembly.

With particularly preferred dispenser embodiments of the present invention, the discharge of the bulk of the liquid product solution generally occurs after the completion of the flush cycle when the toilet tank is beginning to refill while a small amount of the product solution is discharged just before the completion of the flush cycle. Where maximum solution concentration in the toilet tank is required, the latter feature is highly desirable, since it ensures that most of the product solution dispensed will be retained in the toilet tank after the flush cycle has been completed. This allows the bulk of the product solution to disperse into the toilet tank water so that the solution can work effectively on the subsequent flush to reduce aerosolization and thereby decrease the possibility of airborne transmission of disease-causing organisms from toilet wastewater.

During the flush cycle, generally all the water from the toilet tank goes through the toilet bowl. However, the initial portions of water are used to initiate a syphon action in the toilet bowl which carries away the waste material, while the latter portions are used to refill the toilet bowl. By dispensing a small amount of the product solution late in the flush cycle, the water used to refill the toilet bowl can be made to contain some visual indicating means to verify that the dispenser is working.

As noted above, dispensers of the present invention are particularly well suited for plural component products particularly if they need to be isolated from each other prior to use. Each dispenser section of such a dual or plural product dispenser will maintain a product component in isolation from the toilet tank water and come, if necessary, from the other product components disposed in other independent sections. Such plural product dispensing embodiments could be fabricated as a single until suspended in the toilet tank independently of one another, or interdependently suspended in the toilet tank by means of a common bracket or the like. Because the constant volume of solution dispensed during each flush cycle may readily be determined, it is thus possible to size such plural product dispensers so that each of the product components will be completely consumed at about the same point in time, thereby minimizing waste of any particular component.

While particular embodiments of the present invention have been illustrated and described, it will be obvious to those skilled in the art that various changes and modifications can be made without departing from the spirit and scope of the invention and it is intended to cover, in the appended claims, all such modifications that are within the scope of this invention. Moreover, while the present invention has been described in the context of dispensing a toilet tank additive, it is not intended to thereby limit the present invention.

What is claimed is:

1. A passive dosing dispenser comprising an internal reservoir for containing a quantity of a solution isolated by means of air-locks from a body of liquid in which said dispenser is immersed and means for causing a pre-determined volume of said solution to be syphoned from said internal reservoir and discharged from said dispenser in response to the level of said body of liquid being lowered from a first elevation to a second elevation, said means comprising an air vent in fluid communication with said reservoir, said air vent including passive means for forming a first air-lock which isolates said solution from said liquid surrounding said dispenser when said air vent is blocked by said liquid, a syphon tube having an inlet/discharge port at its lower end, an inlet/discharge conduit having a top end in fluid communication with the upper reaches of said syphon tube and a bottom end in fluid communication with said internal reservoir, said internal reservoir being in fluid communication exclusively with said inlet/discharge conduit and said air vent, said internal reservoir including a product chamber adapted to hold a quantity of a solid-state product which is soluble in said liquid and for being flooded to a predetermined depth with said liquid to form said solution in said internal reservoir by dissolving some of said solid-state product, said dispenser further including a first air trap disposed adjacent said inlet/discharge conduit, said first air trap serving to retain an air bubble as said internal reservoir is being filled by said liquid, said first air trap thereafter permitting said air bubble to reposition itself when said liquid ceases to enter said internal reservoir, thereby forming a second air-lock which isolates said solution from said liquid surrounding said dispenser, said dispenser also including a second air trap disposed adjacent said syphon tube, said second air trap serving to retain said air bubble as said solution is being syphoned from said internal reservoir and discharged from said dispenser in response to the level of said body of liquid being lowered from said first elevation to said second elevation, said second air trap thereafter permitting said air bubble to enter said first air trap in response to said internal reservoir being filled as said body of liquid is being raised from said second elevation to said first elevation, said dispenser further including means for being so disposed in said body of liquid that said internal reservoir will be filled with a pre-determined volume of said liquid when the level of said body of liquid is raised to said first elevation and so that a pre-determined volume of said solution will be drawn from said internal reservoir by suction via said inlet/discharge conduit into said syphon type and discharged from said dispenser when the level of said solution in said internal reservoir is lowered to the bottom end of said inlet/discharge conduit in response to said body of liquid being lowered to said second elevation.

2. The dispenser of claim 1, wherein said means for disposing said dispenser in said body of liquid comprises support means for positioning said dispenser in said body of liquid so that said air vent is blocked by said body of liquid at said first elevation and said inlet/discharge port of said syphon tube is above said body of liquid at said second elevation, whereby said internal reservoir will be filled with a pre-determined dose-volume of said liquid when the level of said body of liquid is raised to said first elevation and so that a pre-determined dose-volume of said solution will be drawn from said internal reservoir by suction via said inlet/discharge conduit into said syphon tube and discharged from said dispenser when the level of said solution in said internal reservoir is lowered to the bottom end of said inlet/discharge conduit in response to said body of liquid being lowered to said second elevation.

3. A passive dosing dispenser comprising an internal reservoir for containing a quantity of a solution isolated by means of air-locks from a body of liquid in which said dispenser is immersed and means for causing a predetermined volume of said solution to be syphoned from said internal reservoir and discharged from said dispenser in response to the level of said body of liquid being lowered from a first elevation to a second elevation, said means comprising an air vent in fluid communication with said reservoir, said air vent including passive means for forming a first air-lock which isolates said solution from said liquid surrounding said dispenser when said air vent is blocked by said liquid, a syphon tube having a discharge reservoir located at its lower end, said discharge reservoir having an inlet/discharge port, and said discharge reservoir in conjunction with said inlet/discharge port serving to delay the discharge of said solution from said dispenser, said dispenser further including an inlet/discharge conduit having a top end in fluid communication with the upper reaches of said syphon tube and a bottom end in fluid communication with said internal reservoir, said internal reservoir being in fluid communication exclusively with said inlet/discharge conduit and said air vent, said internal reservoir including a product chamber adapted to hold a quantity of a solid-state product which is soluble in said liquid and for being flooded to a predetermined depth with said liquid to form said solution in said internal reservoir by dissolving some of said solid-state product, said dispenser further including a first air trap disposed adjacent said inlet/discharge conduit, said first air trap serving to retain an air bubble as said internal reservoir is being filled by said liquid, said first air trap thereafter permitting said air bubble to reposition itself when said liquid ceases to enter said internal reservoir, thereby forming a second air-lock which isolates said solution from said liquid surrounding said dispenser, said dispenser also including a second air trap disposed adjacent said syphon tube, said second air trap serving to retain said air bubble as said solution is being syphoned from said internal reservoir and discharged from said dispenser in response to the level of said body of liquid being lowered from said first elevation to said second elevation, said second air trap thereafter permitting said air bubble to enter said first air trap in response to said internal reservoir being filled as said body of liquid is being raised from said second elevation to said first elevation, said dispenser further including means for being so disposed in said body of liquid that said internal reservoir will be filled with a pre-determined volume of said liquid when the level of said body of liquid is raised to said first elevation and so that up to a pre-determined volume of said solution will be drawn from said internal reservoir by suction via said inlet/discharge conduit into said syphon tube and discharged from said dispenser when the level of said solution in said internal reservoir is lowered to the bottom end of said inlet/discharge conduit in response to said body of liquid being lowered to said second elevation.

4. The dispenser of claim 3, wherein said means for disposing said dispenser in said body of liquid comprises support means for positioning said dispenser in said body of liquid so that said air vent is blocked by said body of liquid at said first elevation and said inlet/discharge port of said syphon tube is above said body of liquid at said second elevation, whereby said internal reservoir will be filled with a pre-determined dose-volume of said liquid when the level of said body of liquid is raised to said first elevation and so that a predetermined dose-volume of said solution will be drawn from said internal reservoir by suction via said inlet/discharge conduit into said discharge reservoir of said syphon tube and discharge from said dispenser when the level of said solution in said internal reservoir is lowered to the bottom end of said inlet/discharge conduit in response to said body of liquid being lowered to said second elevation.

5. The dispenser of claims 1 or 3 wherein said means for providing said first air-lock in said air vent in fluid communication with said reservoir comprises a pair of vertical passageways in fluid communication with one another only at their uppermost ends to isolate said solution from said liquid surrounding said dispenser.

6. A passive dosing dispenser comprising an internal reservoir for containing a quantity of a solution isolated by means of air locks from a body of liquid in which said dispenser is immersed and means for causing a predetermined volume of said solution to be syphoned from said internal reservoir and discharged from said dispenser in response to the level of said body of liquid being lowered from a first elevation to a second elevation, said means comprising an air vent in fluid communication with said reservoir, a syphon tube having an inlet/discharge port in its lower end, an inlet/discharge conduit having a top end in fluid communication with the upper reaches of said syphon tube and a bottom end in fluid communication with said internal reservoir, said internal reservoir including a product chamber adapted to hold a quantity of a solid-state product which is soluble in said liquid and for being flooded to a predetermined depth with said liquid to form said solution in said internal reservoir by dissolving some of said product, a first air trap disposed adjacent said inlet/discharge conduit, said first air trap serving to retain an air bubble as said internal reservoir is being filled by said liquid, said first air trap thereafter permitting said air bubble to reposition itself when said liquid ceases to enter said internal reservoir, thereby forming an air-lock which isolates said solution from said liquid surrounding said dispenser, said dispenser also including a second air trap disposed adjacent said syphon tube, said second air trap serving to retain said air bubble as said solution is being syphoned from said internal reservoir and issued from said dispenser in response to the level of said body of liquid being lowered form said first elevation to said second elevation, said second air trap thereafter permitting said air bubble to enter said first air trap in response to said internal reservoir being filled as said body of liquid is being raised from said second elevation to said first elevation, said internal reservoir being in fluid communication exclusively with said inlet/discharge conduit and said air vent, said dispenser further including means for being so disposed in said body of liquid that said internal reservoir will be filled with a pre-determined volume of said liquid without said air vent being blocked by said liquid when the level of said body of liquid is raised to said first elevation and so that a predetermined volume of said solution can be drawn from said internal reservoir by suction via said inlet/discharge conduit into said syphon tube and discharged from said dispenser when the level of said solution in said internal reservoir is lowered to the bottom end of said inlet/discharge conduit in response to said body of liquid being lowered to said second elevation.

7. The dispenser of claim 6, wherein said means for disposing said dispenser in said body of liquid comprises support means for positioning said dispenser in said body of liquid so that said air vent is blocked by said body of liquid at said first elevation and said inlet/discharge port of said syphon tube is above said body of liquid at said second elevation, whereby said internal reservoir will be filled with a pre-determined dose-volume of said liquid when the level of said body of liquid is raised to said first elevation and so that a predetermined dose-volume of said solution will be drawn from said internal reservoir by suction via said inlet/discharge conduit into said syphon tube and discharged from said dispenser when the level of said solution in said internal reservoir is lowered to the bottom end of said inlet/discharge conduit in response to said body of liquid being lowered to said second elevation.

8. A passive dosing dispenser comprising an internal reservoir for containing a quantity of a solution isolated by means of air-locks from a body of liquid in which said dispenser is immersed and means for causing a pre-determined volume of said solution to be syphoned from said internal reservoir and discharged from said dispenser in response to the level of said body of liquid being lowered from a first elevation to a second elevation, said means comprising an air vent in fluid communication with said reservoir, a syphon tube having a discharge reservoir located at its lower end, said discharge reservoir having an inlet/discharge port, and said discharge reservoir in conjunction with said inlet/-discharge port serving to delay the discharge of said solution from said dispenser, said dispenser further including an inlet/discharge conduit having a top end in fluid communication with the upper reaches of said syphon tube and a bottom end in fluid communication with said internal reservoir, said internal reservoir being in fluid communication exclusively with said inlet/discharge conduit and said air vent, said internal reservoir including a product chamber adapted to hold a quantity of a solid-state product which is soluble in said liquid and for being flooded to a predetermined depth with said liquid to form said solution in said internal reservoir by dissolving some of said solid-state product, said dispenser further including a first air trap disposed adjacent said inlet/discharge conduit, said first air trap serving to retain an air bubble as said internal reservoir is being filled by said liquid, said first air trap thereafter permitting said air bubble to reposition itself when said liquid ceases to enter said internal reservoir, thereby forming an air-lock which isolates said solution from said liquid surrounding said dispenser, said dispenser also including a second air trap disposed adjacent said syphon tube, said second air trap serving to retain said air bubble as said solution is being syphoned from said internal reservoir and issued from said dispenser in response to the level of said body of liquid being lowered from a first elevation to a second elevation, said second air trap thereafter permitting said air bubble to enter said first air trap in response to said internal reservoir being filled as said body of liquid is being raised from said second elevation to said first elevation, said dispenser further including means for being so disposed in said body of liquid that said internal reservoir will be filled with a pre-determined volume of said liquid without said air vent being blocked by said liquid when the level of said body of liquid is raised to said first elevation and so that a pre-determined volume of said solution will be drawn from said internal reservoir by suction via said inlet/discharge conduit into said syphon tube and discharged from said dispenser when the level of said solution in said internal reservoir is lowered to the bottom end of said inlet/discharge conduit in response to said body of liquid being lowered to said second elevation.

9. The dispenser of claim 8, wherein said means for disposing said dispenser in said body of liquid comprises support means for positioning said dispenser in said body of liquid so that said air vent is blocked by said body of liquid at said first elevation and said inlet/discharge port of said syphon tube is above said body of liquid at said second elevation, whereby said internal reservoir will be filled with a pre-determined dose-volume of said liquid when the level of said body of liquid is raised to said first elevation and so that a pre-determined dose-volume of said solution will be drawn from said internal reservoir by suction via said inlet/discharge conduit into said discharge reservoir of said syphon tube and discharged from said dispenser when the level of said solution in said internal reservoir is lowered to the bottom end of said inlet/discharge conduit in response to said body of liquid being lowered to said second elevation.

10. The dispenser of claims 3 or 6 wherein said discharge reservoir and said inlet/discharge port of said syphon tube are sized to delay the discharge of said solution from said dispenser so that a portion of said solution will be discharged from said dispenser while the level of said body of liquid is being raised from said second elevation to said first elevation.

11. The dispenser of claim 10 wherein said means for disposing said dispenser in said body of liquid comprises support means for positioning said dispenser in said body of liquid so that said solution will be completely discharged prior to the level of said body of liquid rising sufficiently to block said inlet/discharge port of said syphon tube.

12. The dispenser of claims 1, 3, 6 or 8 wherein said first and said second air traps are each comprised of an expanded cross-sectional flow area followed by a constricted cross-sectional flow area, as measured in a plane substantially perpendicular to the direction of flow past said first and said second air traps.

13. The dispenser of claims 1, 3, 6 or 8 wherein said first and said second air trap are each of sufficient volume to fill the top end of said inlet/discharge conduit and the upper reaches of said syphon tube and thereby isolate said solution in said inlet/discharge conduit from said liquid in said syphon tube when said body of liquid is at said first elevation.

14. The dispenser of claims 1, 3, 6 or 8 including a level control partition in said product chamber in said internal reservoir to permit flooding said internal reservoir to a pre-determined depth.

15. The dispenser of claims 1, 3, 6 or 8 including means for retaining a pre-determined quantity of said solution within said reservoir after said liquid has been lowered from said first elevation to said second elevation.

16. The dispenser of claims 1, 3, 6 or 8 including a clog prevention means in said internal reservoir for use with a solid-state product having a tendency to form a gel during dissolution of said solid-state product, said clog prevention means serving to prevent said gel from obstructing the flow of said solution within said internal reservoir and said liquid syphoning means.

17. The dispenser of claim 16 wherein said clog prevention means comprises:

a. means to prevent the gel formed during dissolution of said solid-state product from obstructing the flow of said liquid solution into or out of the lowermost portion of said solid-state product chamber; and b. means for controlling the amount of solid-state product exposed to said liquid solution in said internal reservoir.

* * * * *

UNITED STATES PATENT AND TRADEMARK OFFICE

CERTIFICATE OF CORRECTION

PATENT NO. : 4,305,162

DATED : December 15, 1981

INVENTOR(S) : WILLIAM CORNELISSE, JR., ROBERT H. CALLICOTT and MICHAEL A. BRUNSMAN It is certified that error appears in the above-identified patent and that said Letters Patent are hereby corrected as shown below:

Column 1, line 14, "receeds" should read -- recedes --.

Column 6, line 46, "location" should read -- isolation --.

Column 16, line 34, "type" should read -- tube --.

Signed and Sealed this

*Third* Day of *August 1982*

[SEAL]

*Attest:*

GERALD J. MOSSINGHOFF

*Attesting Officer*

*Commissioner of Patents and Trademarks*